US010843059B2

(12) United States Patent
Koch

(10) Patent No.: US 10,843,059 B2
(45) Date of Patent: Nov. 24, 2020

(54) GOLF SWING TRAINING DEVICE

(71) Applicant: RM&G Products, Medina, OH (US)

(72) Inventor: Robert Koch, Media, OH (US)

( * ) Notice: Subject to any disclaimer, the term of this patent is extended or adjusted under 35 U.S.C. 154(b) by 0 days.

(21) Appl. No.: 15/780,893

(22) PCT Filed: Nov. 28, 2016

(86) PCT No.: PCT/US2016/063856

§ 371 (c)(1),
(2) Date: Jun. 1, 2018

(87) PCT Pub. No.: WO2017/095742

PCT Pub. Date: Jun. 8, 2017

(65) Prior Publication Data

US 2018/0353827 A1 Dec. 13, 2018

Related U.S. Application Data

(60) Provisional application No. 62/261,941, filed on Dec. 2, 2015.

(51) Int. Cl.

| | |
|---|---|
| ***A63B 69/36*** | (2006.01) |
| ***A63B 53/02*** | (2015.01) |
| ***A63B 60/00*** | (2015.01) |

(52) U.S. Cl.

CPC ..... *A63B 69/3632* (2013.01); *A63B 53/02* (2013.01); *A63B 60/00* (2015.10); *A63B 2053/027* (2013.01); *A63B 2060/0081* (2015.10)

(58) Field of Classification Search

CPC ..... A63B 2060/0081; A63B 2053/023; A63B 2053/025–027; A63B 69/3632; A63B 53/02; A63B 60/00; A63B 2053/027

(Continued)

(56) References Cited

U.S. PATENT DOCUMENTS 3,033,575 A * 5/1962 Hause ..... A63B 53/00 473/232
4,854,585 A * 8/1989 Koch ..... A63B 69/3632 473/232

(Continued)

FOREIGN PATENT DOCUMENTS

JP 2015 533335 A 11/2015

OTHER PUBLICATIONS

European Patent Office, International Search Report and Written Opinion for corresponding PCT/US2016/063856, dated Feb. 10, 2017, pp. 1-9.

*Primary Examiner* — Jeffrey S Vanderveen
(74) *Attorney, Agent, or Firm* — Tucker Ellis LLP; Patrick F. Clunk

(57) ABSTRACT

A golf swing training device including a hinge interposed between two elongated members. The hinge permits the elongated members to selectively break from longitudinal alignment along a first axis with the first elongated member when a prescribed differential force between the first elongated member and the second elongated member is applied to break the longitudinal alignment. The golf swing training device includes a club head including a club head face and a hosel, wherein the hosel is configured to receive an end of the second elongated member. The hosel includes a face angle adjustment mechanism having a plurality of settings to adjust a club face angle of the club head relative to one or more axes of the hinge assembly. A fastener is configured to releasably secure the club head through the hosel to one of the elongate members.

18 Claims, 8 Drawing Sheets

(58) Field of Classification Search
USPC ..... 473/232, 307
See application file for complete search history.

(56) References Cited

U.S. PATENT DOCUMENTS

| | | | | | |
|---|---|---|---|---|---|
| 4,856,782 | A * | 8/1989 | Cannan | A63B 53/00 | 473/232 |
| 5,277,427 | A * | 1/1994 | Bryan | A63B 69/3632 | 403/157 |
| 5,489,100 | A * | 2/1996 | Potter | A63B 69/3632 | 403/104 |
| 6,007,341 | A | 12/1999 | Koch | | |
| 6,257,992 | B1 | 7/2001 | LeBlanc | | |
| 2011/0111881 | A1* | 5/2011 | Sander | A63B 53/02 | 473/307 |
| 2013/0296069 | A1* | 11/2013 | Beach | A63B 60/00 | 473/307 |
| 2014/0080617 | A1* | 3/2014 | Llewellyn | A63B 53/0466 | 473/246 |
| 2014/0121032 | A1* | 5/2014 | Stites | A63B 53/00 | 473/244 |
| 2014/0295987 | A1 | 10/2014 | Moore | | |

* cited by examiner

GOLF SWING TRAINING DEVICE

RELATED APPLICATION DATA

This application is a national phase application of International Application No. PCT/US2016/063856 filed Nov. 28, 2016 and published in the English language, which claims the benefit of U.S. Provisional Application No. 62/261,941 filed Dec. 2, 2015, which is hereby incorporated herein by reference.

FIELD OF THE INVENTION

The invention relates generally to training devices for improving a golfer's golf game, and more specifically to a training club for improving the golfer's swing.

BACKGROUND

There are few sports that attract as broad a range of people as golf. Because of the nature of golf most everyone can enjoy the sport but very few have mastered it.

One of the most basic and most difficult aspects of the game is developing a proper golf swing. A desired golf swing is smooth with the golf club remaining in a constant plane throughout the swing. The golf club is taken away from the ball at a smooth, even tempo to the top of the backswing. The downswing follows with the club staying in the same plane as in the backswing with the club head being smoothly accelerated through impact with the golf ball.

While the basic proper golf swing is simple to describe and to visualize, it is very difficult for all but the most accomplished golfers to achieve. Consequently, there are countless devices on the market for improving a golfer's swing. While many of these devices help to varying degrees, most only apply to small aspects of the swing.

One golf swing training device that has met with critical acclaim from golf professionals and golf publications alike is the Medicus® training club marketed by RM&G Products. The Medicus® training club looks very similar to a conventional golf club. When swung properly the Medicus® training club indeed acts like a conventional golf club and can be used to hit a golf ball. When the Medicus® training club is swung improperly, however, such as when it is not swung at a relatively even tempo, it provides instant feedback to the golfer of the swing defect.

The Medicus® training club includes a conventional club head and grip, but has an adjustable hinge interposed in the shaft of the club permitting the shaft to articulate or break at the point in the swing that the club is not being swung properly. The club offers the advantage that it provides immediate feedback and can be swung almost anywhere without requiring the actual striking of a golf ball. The hinge is adjustable to allow golfers of varying skill levels to use the training club. The Medicus® training club is disclosed in U.S. Pat. Nos. 4,854,585, 5,195,748, and 6,007,341, which are incorporated herein by this reference.

While the Medicus® training club and the clones of the Medicus® training club have helped countless golfers to develop a better golf swing by correcting certain defects in their normal swings, it is desirable to have a training device with a hinge that may be used by many types of golfers to practice their conventional swings, as well as permitting adjustments between the hinge and club head in order to enable golfers to practice different types of swings and/or golf shots.

SUMMARY OF THE INVENTION

One aspect of the present application is to provide a golf training club having a hinge that enables adjustment of the club face relative to the hinge in order to enable golfers to practice different types of swings and/or golf shots.

Another aspect of the application relates to a golf swing training device including: a plurality of elongate shaft sections connected by a plurality of hinge sections enabling the shaft sections to articulate about a plurality of distinct axes; wherein one of the elongate shaft sections includes a first end; a club head including a club head face and a hosel, wherein the hosel is configured to receive the first end of the one elongate shaft section; and the hosel includes a club face angle adjustment mechanism having a plurality of settings to adjust a club face angle of the club head relative to the plurality of hinge sections; and a fastener configured to releasably secure the club head through the hosel to the first end of the one shaft section.

Another aspect of the application is directed to a golf swing training device including: an elongated shaft having a first elongated member and a second elongated member; a hinge interposed between the first elongated member and the second elongated member, wherein the hinge permits the second elongated portion to selectively break from longitudinal alignment along a first axis with the first elongated member when a prescribed differential force between the first elongated member and the second elongated member is applied to break the longitudinal alignment; a club head including a club head face and a hosel, wherein the hosel is configured to receive an end of the second elongated member; and the hosel includes a face angle adjustment mechanism having a plurality of settings to adjust a club face angle of the club head relative to the plurality of hinge sections; and a fastener configured to releasably secure the club head through the hosel to the end of the second elongated member.

DETAILED DESCRIPTION OF THE INVENTION

Figure 1:
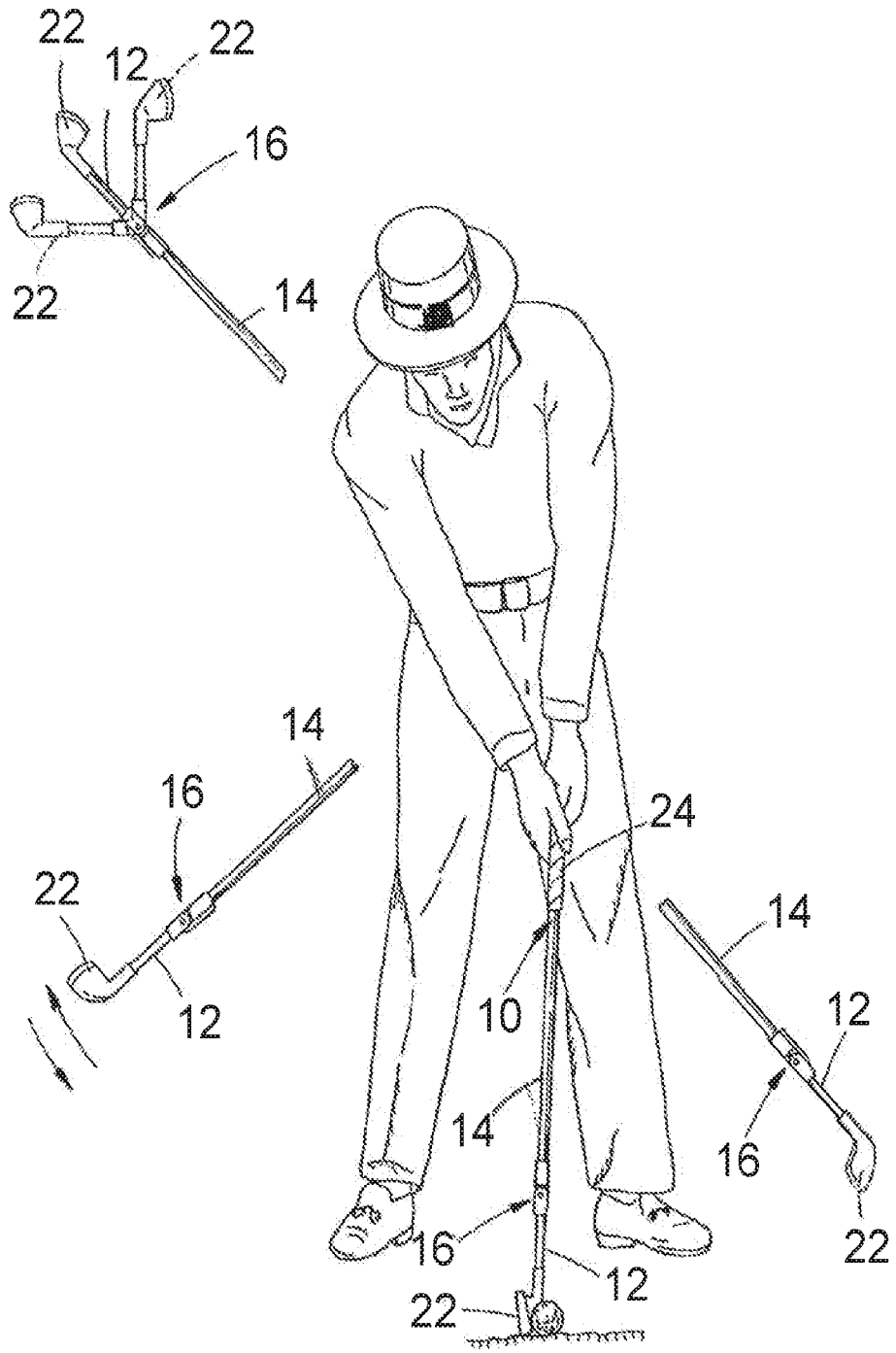
FIG. 1 is an illustration of a golfer holding the training club of the present invention.
Figure 2:
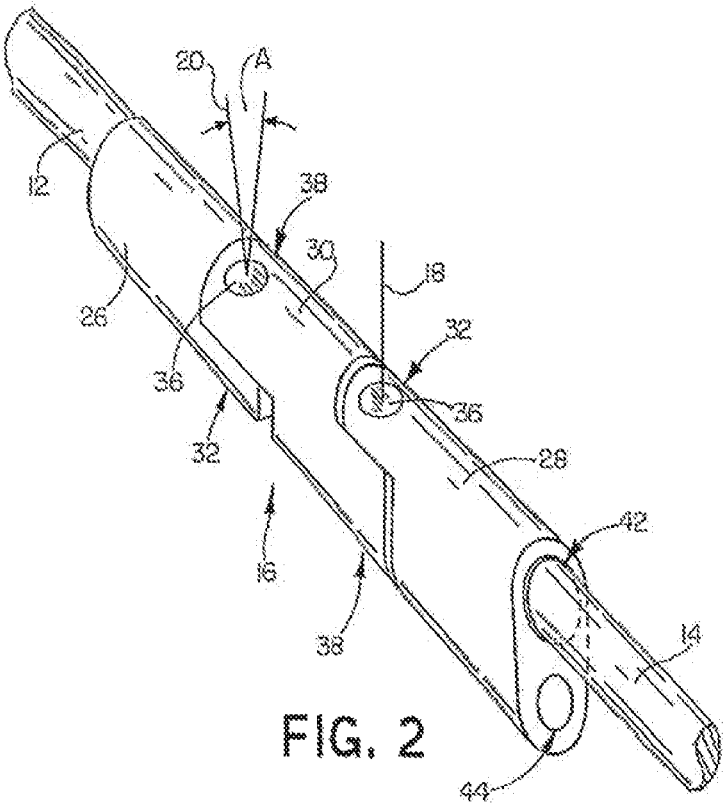
FIG. 2 is an illustration of a hinge assembly in accordance with one embodiment of the invention.

With reference to the figures in general and initially to FIG. 1 in specific, there is shown a golf swing training device 10 as held by a golfer before the beginning of a swing, also called at address. The training device 10 includes lower and upper elongate shaft sections 12 and 14, respectively, connected at their confronting ends by a hinge apparatus 16. The hinge apparatus 16 may be a simple hinge having a single axis of rotation or may have multiple hinge axes (e.g., two distinct hinge axes 18 and 20), as shown in FIG. 2. At the lower end of the lower shaft section 12 is secured a club head 22, while at the upper end of the upper shaft section 14 is secured a grip 24 as in a conventional golf club. Preferably, the hinge assembly 16 is located at or near the center of gravity of the training device 10, but may be located at other places along the length of the shaft.

The shaft sections 12 and 14, the club head 22 and the grip 24 may be of similar or the same design as like components in a conventional golf club. The club head 22 may be a five iron, for example, a driver, or any other club head configuration.

The hinge assembly 16 may be constructed of any number of materials, such as stainless steel or aluminum, and in a number of different designs which result in a hinge assembly which is preferably strong and lightweight, adaptable to connect to the shaft sections 12 and 14, and which has one or more distinct rotational hinge axes (e.g., axes 18 and 20). It is also desirable that the hinge assembly 16 include a biasing element, discussed more fully below, which biases the hinge assembly to maintain the shaft sections 12 and 14 in longitudinal alignment during a relatively proper golf swing. The biasing element may be adjustable to vary the sensitivity of the hinge to articulate at different swing imperfection magnitudes.

The hinge axes 18 and 20 may be rotationally offset relative to one another to varying degrees, for example, zero to 25 degrees (designated by A in FIG. 2), but preferably generally 15 degrees, depending on the swing error the training device is adapted to detect. An average golfer typically swings the club during the downswing with the club head 22 following along an outside to inside swing path, rather than in a constant plane, and thus hits the ball so as to impart a spin on the ball that causes the ball to fly in an arcing trajectory called a slice. For such a golfer, one hinge axis (e.g., axis 18) may extend generally perpendicular to the plane of a proper swing while the hinge axis 20 may be rotationally offset approximately 15 degrees in the direction of the eventual ball flight.

The hinge axis 18 lying perpendicular to a proper swing plane functions to detect swing imperfections which cause a torque on the hinge assembly 16 exceeding the centrifugal force generated by the swing of the club and the biasing force from the biasing element. For example, if the training club 10 is accelerated at an uneven rate generally in the swing plane, such as may be caused by improper movement of the arms or hands or body, the shaft sections 12 and 14 will desirably articulate about the hinge 16 (e.g., hinge axis 18) providing immediate feedback to the golfer of the swing defect, as denoted by upper left hand portion of FIG. 1. In the case of an outside to inside swing, the training club 10 will be more likely to articulate around the hinge axis 20 to indicate the swing fault than if the training device only included a single hinge axis 18, because the hinge axis 20 will lie closer to perpendicular to this improper swing path. Consequently, the incorporation of a hinge assembly 16 having two distinct hinge axes 18 and 20 allows the training club 10 of the present application to detect more swing faults than a similar training club with a single hinge axis.

Figure 3:
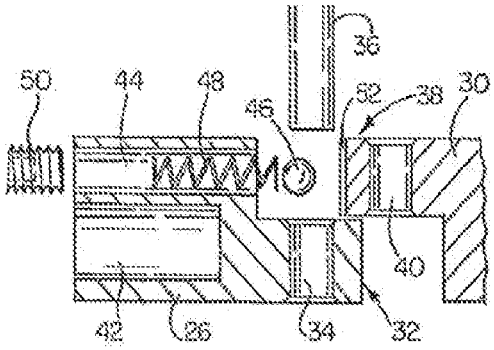
FIG. 3 is a cross-sectional, exploded view of a portion of the hinge assembly shown in FIG. 2.

One exemplary hinge assembly 16 is shown in FIGS. 2 and 3 as a three piece hinge, although other hinge assemblies performing substantially the same function may be used as would be readily appreciated. The hinge assembly 16 includes a pair of hinge ends 26 and 28 and an interconnecting element 30. Each hinge end 26, 28 is generally oval in cross-section and includes a mating flange 32 having a through bore 34 adapted to receive a pin 36 for mating engagement with a similar mating flange 38 of the interconnecting element 30 having a through bore 40. The interconnecting element 30 will of course have two mating flanges 38 with one on either side of the interconnecting element for hinged connection with one of the hinge ends.

Each hinge end 26 and 28 further includes a pair of parallel bores 42 and 44, one bore 42 extending only partly through the hinge end and adapted to receive and secure a shaft section 12 such as by gluing and the other bore 44 extending through the hinge end to receive a ball bearing 46, a spring 48 and a set screw 50.

The ball bearing 46, the spring 48 and set screw 50 retained in the bore 44 along with a detent 52 in the interconnecting element 30 cooperatively form an adjustable biasing mechanism for biasing the shaft sections 12 and 14 in longitudinal or unbroken alignment. The detent 52 may be in an angular or semi-cylindrical shape and size so as to retain a portion of the ball bearing 50, thus resisting articulation of the hinge assembly 16, while allowing the ball bearing to be forced back into the bore 44 and the hinge assembly to articulate under a sufficient torsional force on the hinge caused by a swing defect. By adjusting the position of the set screw 50, the force that the spring 48 exerts on the ball bearing 46 and that the ball bearing in turn exerts on the detent 52 can be adjusted to a desired amount. To facilitate ease of adjustment, the set screw preferably includes a receptacle for an allen wrench. Alternatively, the biasing force may not be adjustable or the hinge may be designed to place the adjustment mechanism in a different location. Further, the desired biasing force may be accomplished through other means including a leaf spring, a cantilever spring, etc.

The ease at which the shaft articulates in a forward or backward direction at the hinge element 16 may be the same or different. If it is desired that the force required to articulate the shaft be different in different directions, for example, so that it is harder to make the shaft break on the backswing and easier during the downswing, that can be accomplished by shaping the detent 52 with different face angles in the relative forward or rearward directions.

Figure 4:
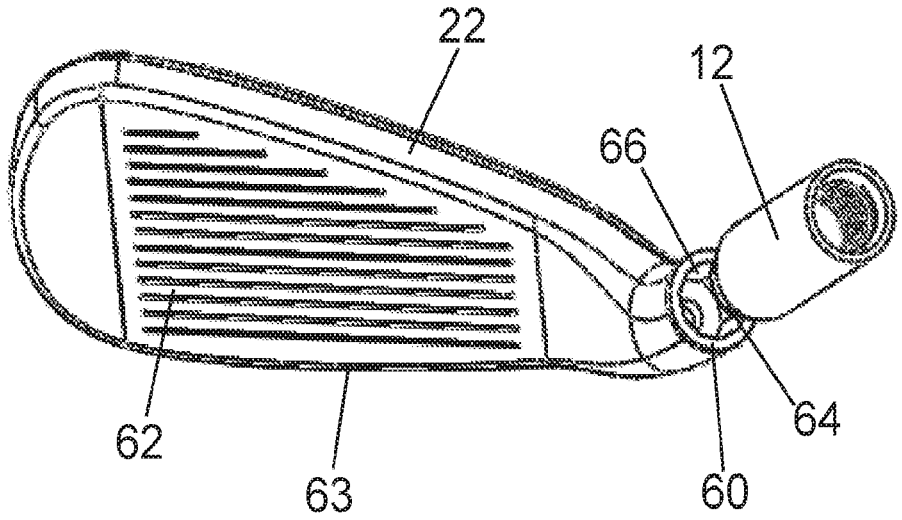
FIG. 4 is a top perspective view of a portion of the training club.

Referring to FIG. 4, the club head 22 includes a hosel 60 and a club head face 62. The hosel 60 is a cavity configured to receive the first end 64 of the one elongate shaft section 12. The hosel 60 includes a face angle adjustment mechanism 66. The face angle adjustment mechanism 66 has any predefined shape or configuration. As illustrated in FIG. 4, the face angle adjustment mechanism 66 is a polygon having, for example, ten sides. A person having ordinary skill in the art will readily appreciate that any desired shape or shapes may be imparted in the hosel 60 and used in accordance with the application.

Figure 5A:
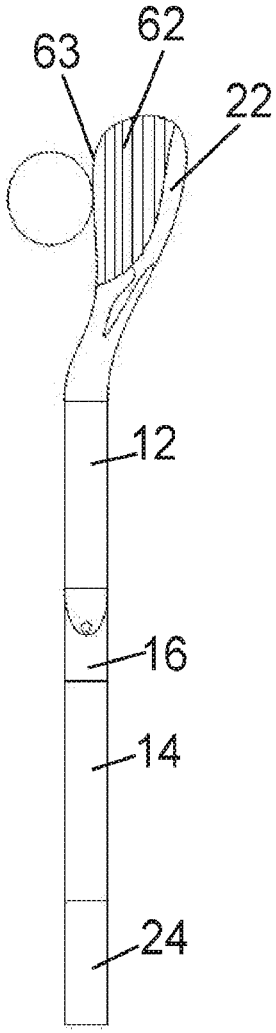
FIGS. 5A-5C are views illustrating exemplary club face positions relative to one or more axes of the hinge assembly.
Figure 5B:
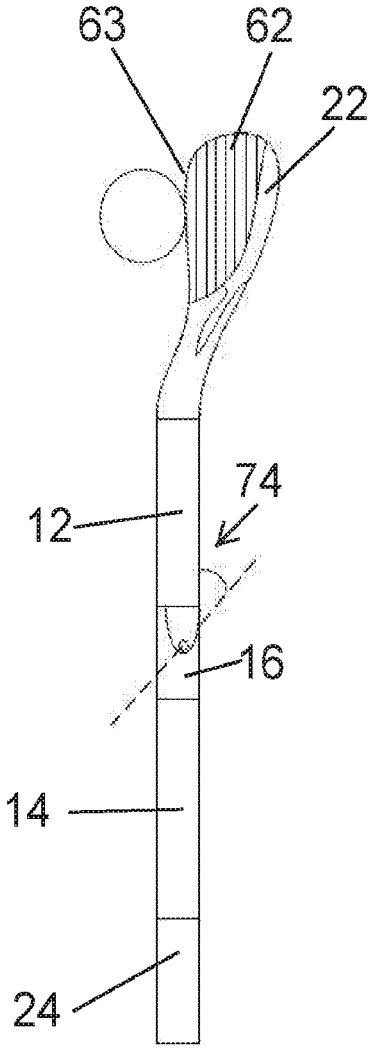
Figure 5C:
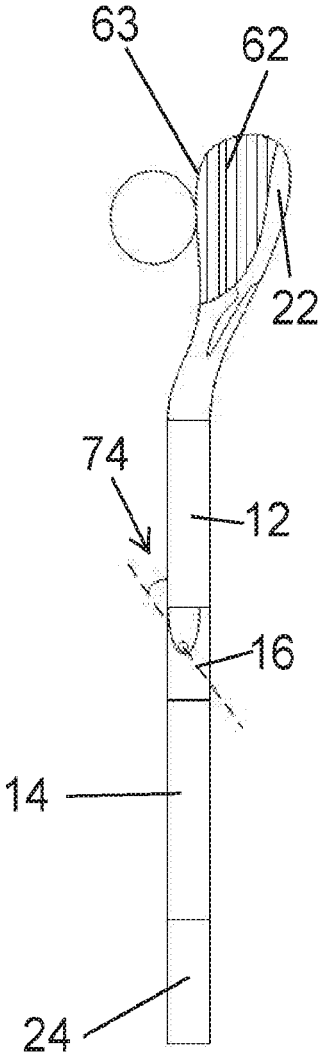

The club face angle adjustment mechanism 66 includes plurality of settings to adjust a club face angle 70 of the club head 22 relative to the hinge assembly 16. Referring to FIG. 5A, the club face has a leading edge 63 that is linear along the club head face 62. The leading edge 63 is parallel or substantially parallel with at least one axis of the hinge assembly 16. In FIG. 5B, the club head 22 has been rotated in a clockwise direction relative to the hinge assembly 16, as discussed below. As such, the leading edge 63 of the club head face 62 is no longer parallel or substantially parallel with one or more axes of the hinge assembly 16. There is an offset angle 74 between the leading edge 63 and the one or more axes of the hinge assembly. This offset angle 74 will depend on the amount of relative rotation between the leading edge 63 and the axis or axes of the hinge assembly. In FIG. 5C, the club head 22 has been rotated in a counter-clockwise direction relative to the hinge assembly 16, which also creates an offset angle 74 between leading edge 63 and the one or more axes of the hinge assembly.

These different offsets enable more golfers that have different or unorthodox swing planes and/or swing mechanics to make use of the swing training device 10. In addition, the different offsets enable golfers with conventional swing planes and/or mechanics to practice different types of swings or shots that require an open or closed clubface.

Figure 6:
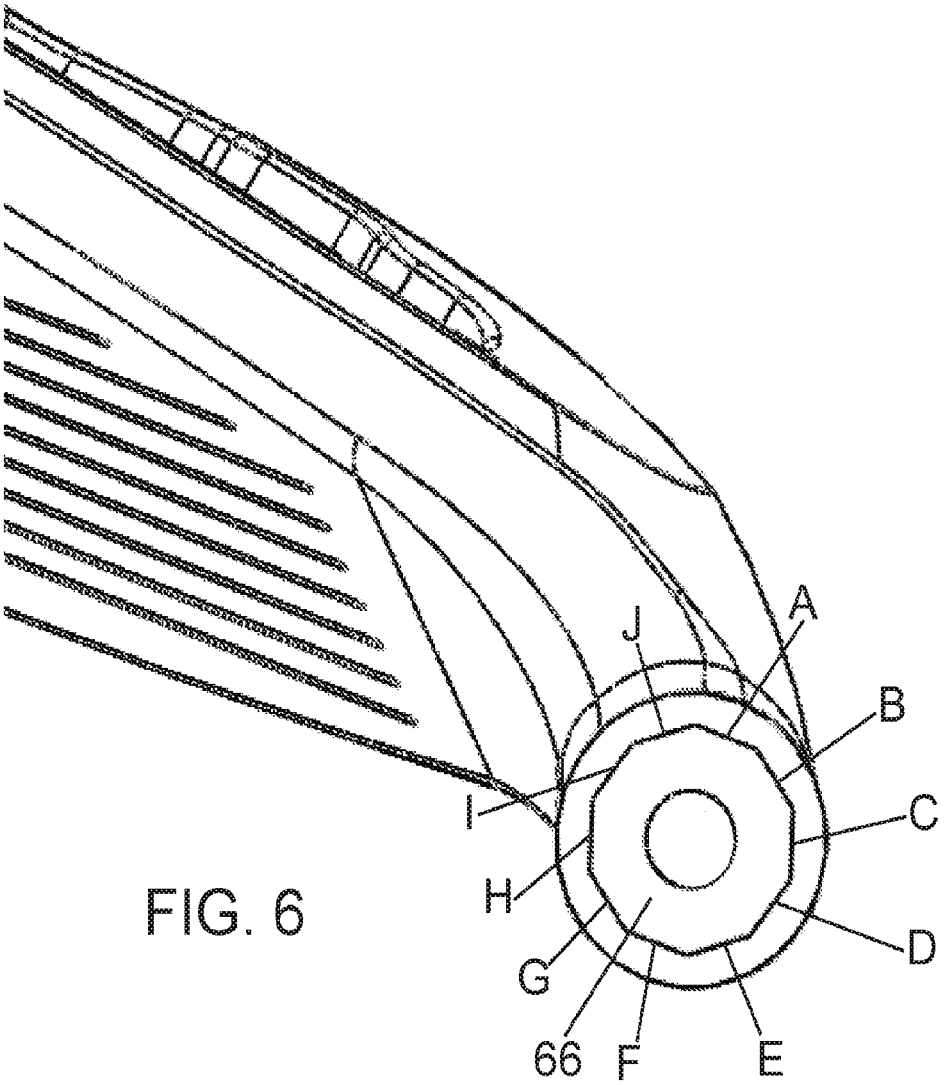
FIG. 6 is a cross-sectional view of an exemplary club face angle adjustment member in accordance with aspects of the present invention.

Referring to FIG. 6, an exemplary cross-section of a club face angle adjustment member 66 is illustrated. The club face angle adjustment member 66 includes a plurality of sides (denoted A-L). As illustrated in FIG. 6, the exemplary club face angle adjustment member 66 has ten (10) sides (A-J). A person having ordinary skill in the art will readily appreciate that the club face angle adjustment member 66 may have a variety of shapes and configurations in accordance with aspects of the present application. The club face angle adjustment member 66 is configured to receive to receive the first end 64 of the one elongate shaft section 12. In one embodiment, the club face angle adjustment member 66 may have a uniform thickness (T) or a varying thickness (T) along one or more of the plurality of sides A-J. Each of the varying thicknesses may provide for a different offset between the club head face 62 and the shaft 12.

Figure 7:
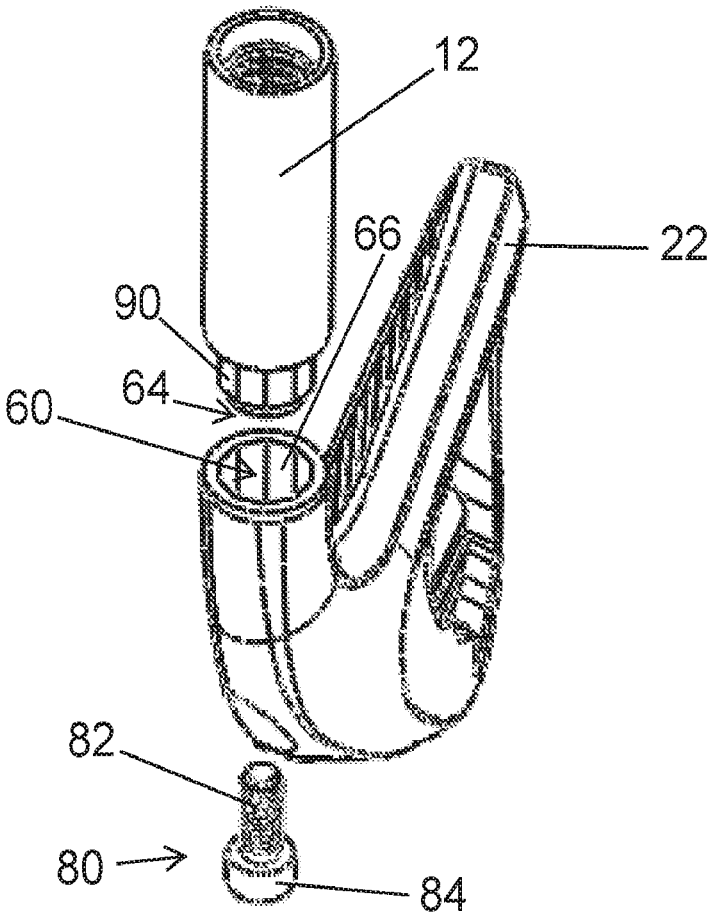
FIG. 7 is a left side perspective view of the exemplary club face angle adjustment member and club head in accordance with aspects of the present invention.
Figure 8:
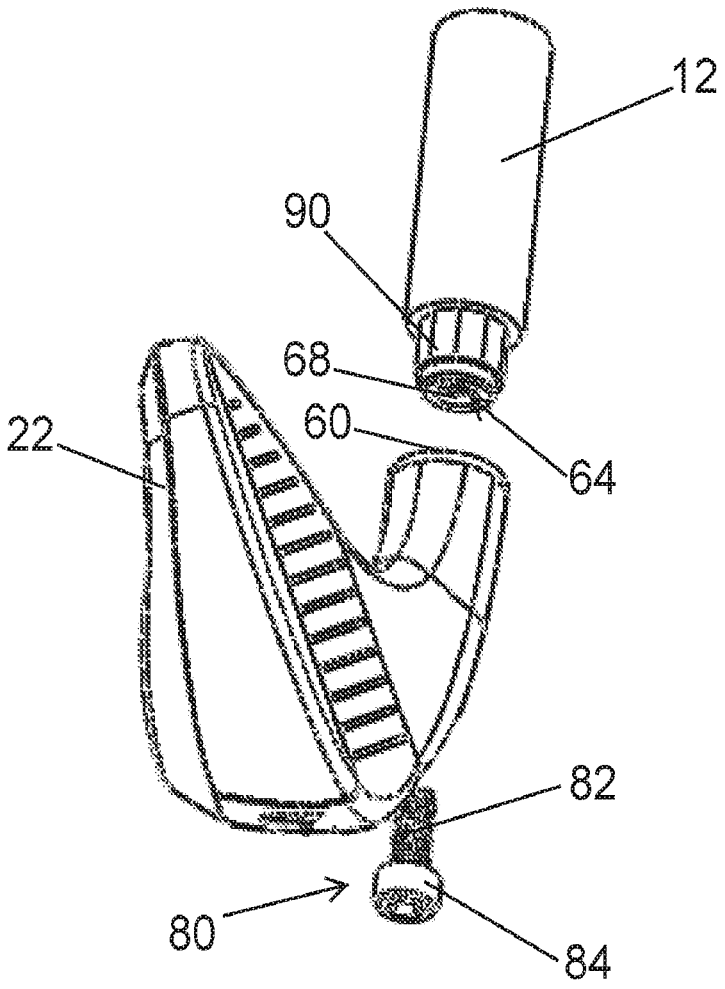
FIG. 8 is a right side perspective view of the exemplary club face angle adjustment member and club head in accordance with aspects of the present invention.

Referring to FIGS. 7 and 8, the first end 64 of the elongate shaft 12 may include a cavity or void 68 formed therein that is configured to receive a fastener 80. The fastener 80 may be configured to releasably secure the club head 22 through the hosel 60. The fastener 80 may be a threaded screw that is received through the hosel 60, such that a portion 82 of the fastener 80 is passes through the hosel 60 to be received within the cavity 68 in the first end 64 and another portion 84 of the fastener 80 (e.g., a head which is wider than the portion passing through the hosel 60, as illustrated in FIGS. 7 and 8.

Figure 9:
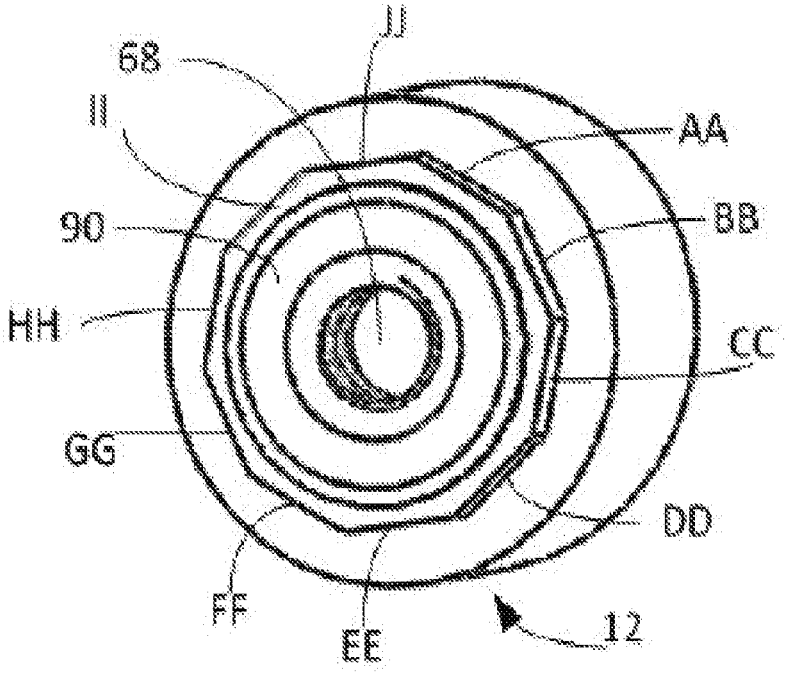
FIG. 9 is a cross-sectional view of an exemplary engagement portion, which mating engages the club face angle adjustment member in accordance with aspects of the present invention.

The elongate shaft 12 also includes an engagement portion 90 that is received by the club face angle adjustment member 66 of the hosel 60. The engagement portion may be any desired shape and is generally shaped to engage with the hosel 60. For example, the engagement portion 90 is operable to matingly engage with the club face angle adjustment member 66 of the hosel 60. As shown in FIG. 9, an exemplary engagement portion 90 includes a plurality of sides (e.g., ten (10) sides AA-JJ). The engagement portion 90 and the club face angle adjustment member 66, when coupled together and secured by the fastener 80, are configured to secure the imparted offset angle between the club head face 62 and the elongate shaft 12 and prevent rotation of the club head face 62 on impact.

In one embodiment, the training device 10 may be pre-configured in a prescribed position (e.g., with the leading edge 63 of club face 62 parallel or substantially parallel with one or more axes of the hinge assembly 16. If a golfer desires to open or close the club face 62 relative to the hinge assembly 16, the golfer removes the fastener 80; removes the first end 64 of the elongate shaft member 12 from the hosel 60; rotates the shaft member 12 and/or the hosel 60 to the desired offset; inserts the first end 64 into the hosel 60; and secures the fastener 80 to the shaft 12, which locks the club head 22 to the elongate shaft 12. This allows a variety of golfers to make use of the swing training device, as well as practicing various golf swings that are used for a variety of different types of golf shots.

Although the invention has been shown and described with respect to certain preferred embodiments, it is obvious that equivalent alterations and modifications will occur to others skilled in the art upon the reading and understanding of this specification. The present invention includes all such equivalent alterations and modifications and is limited only by the scope of the following claims.

What is claimed is:

1. A golf swing training device comprising:

a plurality of elongate shaft sections connected by a plurality of hinge sections enabling the shaft sections to articulate about a plurality of distinct axes; wherein one of the elongate shaft sections includes a first end, and wherein the one of the elongate shaft sections includes an engagement portion extending around a radially outer surface thereof at the first end;

a club head including a club head face and a hosel, wherein the hosel is configured to receive the first end of the one elongate shaft section; and the hosel includes a club face angle adjustment mechanism extending around an inner surface thereof having a plurality of settings to adjust a club face angle of the club head relative to the plurality of hinge sections, wherein the club face angle adjustment mechanism is configured to receive and matingly engage with the engagement portion; and a fastener configured to releasably secure the club head through the hosel to the first end of the one shaft section, wherein the plurality of elongate shaft sections each have a longitudinal axis, wherein the hosel has a central axis, and wherein the longitudinal axis of each shaft section is coextensive with the central axis in each of the plurality of settings of the club face angle adjustment mechanism when the plurality of shaft sections are not articulated.

2. The device of claim 1, wherein the face angle adjustment mechanism includes a plurality of sides and the engagement portion includes a plurality of sides that engage with the plurality of sides of the face angle adjustment mechanism.

3. The device of claim 2, wherein the predetermined shape is formed on a surface of the one elongate shaft.

4. The device of claim 1, wherein the first end of the one elongate shaft includes a threaded portion for receiving the fastener.

5. The device of claim 1, wherein the face angle adjustment mechanism includes a plurality of pre-defined settings.

6. The device of claim 1, wherein the face angle adjustment mechanism is configured to secure a leading edge of the club head face in a parallel position relative to at least one of the distinct axes of the hinge assembly.

7. The device of claim 1, wherein the face angle adjustment mechanism is configured to secure a leading edge of the club head face in a non-parallel position relative to at least one of the distinct axes of the hinge assembly.

8. The device of claim 7, wherein the face angle adjustment mechanism is also configured to secure a leading edge of the club head face in a parallel position relative to at least one of the distinct axes of the hinge assembly.

9. The device of claim 1, wherein the fastener is a threaded member.

10. The device of claim 1, wherein the face angle adjustment mechanism is polygonal and the engagement portion is polygonal to matingly engage with the face angle adjustment portion.

11. A golf swing training device comprising:

an elongated shaft having a first elongated member and a second elongated member;

a hinge interposed between the first elongated member and the second elongated member, wherein the hinge permits the second elongated portion member to selectively break from longitudinal alignment along a first axis with the first elongated member when a prescribed differential force between the first elongated member and the second elongated member is applied to break the longitudinal alignment;

a club head including a club head face and a hosel, wherein the hosel is configured to receive an end of the second elongated member; and the hosel includes a face angle adjustment mechanism having a plurality of settings to adjust a club face angle of the club head relative to the plurality of hinge sections; and a fastener configured to releasably secure the club head through the hosel to the end of the second elongated member, wherein the second elongated member includes an engagement portion having a plurality of sides extending around a radially outer surface thereof configured to matingly engage with a plurality of sides of the face angle adjustment mechanism of the club head, wherein the second elongated member has a longitudinal axis, wherein the hosel has a central axis, and wherein the longitudinal axis is coextensive with the central axis in each of the plurality of settings of the face angle adjustment mechanism, and wherein the first elongated member has a longitudinal axis that is coextensive with the central axis of the hosel in each of the plurality of settings of the club face angle adjustment mechanism when the second elongated member is in longitudinal alignment along the first axis.

12. The device of claim 11, wherein the face angle adjustment mechanism includes a predetermined shape.

13. The device of claim 12, wherein the predetermined shape is formed on a surface of the second elongated member.

14. The device of claim 11, wherein the face angle adjustment mechanism includes a plurality of pre-defined settings.

15. The device of claim 11, wherein the face angle adjustment mechanism is configured to secure a leading edge of the club head face in a parallel position relative to the first axis.

16. The device of claim 11, wherein the face angle adjustment mechanism is configured to secure a leading edge of the club head face in a non-parallel position relative to the first axis.

17. The device of claim 16, wherein the face angle adjustment mechanism is also configured to secure a leading edge of the club head face in a parallel position relative to the first axis.

18. The device of claim 11, wherein the face angle adjustment mechanism is polygonal and the engagement portion is polygonal to matingly engage with the face angle adjustment portion.

* * * * *